US010603918B2

(12) United States Patent
Ozawa

(10) Patent No.: US 10,603,918 B2
(45) Date of Patent: Mar. 31, 2020

(54) RECORDING APPARATUS

(71) Applicant: SEIKO EPSON CORPORATION, Tokyo (JP)

(72) Inventor: Kinya Ozawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/142,881

(22) Filed: Sep. 26, 2018

(65) Prior Publication Data

US 2019/0100010 A1 Apr. 4, 2019

(30) Foreign Application Priority Data

Sep. 29, 2017 (JP) ..... 2017-189829

(51) Int. Cl.
*B41J 2/17* (2006.01)

(52) U.S. Cl.
CPC ..... *B41J 2/1714* (2013.01)

(58) Field of Classification Search
CPC ..... B41J 2/1714
See application file for complete search history.

(56) References Cited

U.S. PATENT DOCUMENTS

| | | | | |
|---|---|---|---|---|
| 7,735,975 | B2 * | 6/2010 | Endo | B41J 2/1721 347/68 |
| 2003/0151639 | A1 | 8/2003 | Takahashi | |
| 2006/0187264 | A1 | 8/2006 | Endo | |
| 2016/0031217 | A1 | 2/2016 | Moriyama et al. | |

FOREIGN PATENT DOCUMENTS

| | | | |
|---|---|---|---|
| JP | 2003-237110 | A | 8/2003 |
| JP | 2004-202867 | A | 7/2004 |
| JP | 2010-143016 | A | 7/2010 |
| JP | 4622571 | B | 11/2010 |
| JP | 2012-183786 | A | 9/2012 |
| JP | 2014-198450 | A | 10/2014 |
| JP | 2014-198452 | A | 10/2014 |
| JP | 2015-039838 | A | 3/2015 |

* cited by examiner

*Primary Examiner* — Geoffrey S Mruk
(74) *Attorney, Agent, or Firm* — Workman Nydegger

(57) ABSTRACT

There is provided a recording apparatus including an apparatus main body including a recording head that ejects liquid from a nozzle opening formed in a nozzle plate, and an upstream electrode portion and a downstream electrode portion that are disposed on an upstream side and a downstream side in a transporting direction of the medium to sandwich the position facing the nozzle plate therebetween, in which the upstream electrode portion and the downstream electrode portion are configured such that an electric field is formed between the upstream electrode portion and the downstream electrode portion as voltages are applied.

8 Claims, 4 Drawing Sheets

RECORDING APPARATUS

BACKGROUND

1. Technical Field

The present invention relates to a recording apparatus that performs recording by ejecting a liquid onto a medium.

2. Related Art

In the related art, as a recording apparatus of this type, there is a liquid ejecting apparatus described in JP-A-2004-202867, for example. This liquid ejecting apparatus includes a recording head for ejecting liquid from a nozzle formed in a nozzle plate and an absorbing member for adsorbing mist-like fine droplets (hereinafter, referred to as "mist") generated when the liquid is ejected from the nozzle. The absorbing member contains a conductive material and is disposed so as to face the nozzle plate with a slight gap therebetween in a vertical direction.

In this liquid ejecting apparatus, a positive voltage is applied to the absorbing member and the nozzle plate is grounded so that an electric field is formed between the absorbing member and the nozzle plate that are opposed in the vertical direction. That is, a positive electric charge is induced in the absorbing member while a negative electric charge is induced in the nozzle plate. The mist floating by being negatively charged by the ejecting from the nozzle of the nozzle plate is directed in the direction of the absorbing member at a positive potential with the opposite polarity so as to be absorbed by the absorbing member.

In the above-described liquid ejecting apparatus, the mist charged to the same polarity (for example, minus) as the nozzle plate is attracted to the absorbing member at the potential with the opposite polarity (for example, plus), but some of the mist generated as liquid is ejected is charged to a polarity opposite to that of the nozzle plate. That is, the mist generated by being separated by air resistance from flying droplets has relatively large particle mist and relatively small particle mist. Relatively large particle mist is negatively charged to the same polarity as the nozzle plate like the droplet ejected from the nozzle of the nozzle plate while relatively small particle mist may be positively charged with a polarity opposite to that of the nozzle plate. For this reason, the positively charged mist is in a state of floating because the mist is a relatively small particle, and there is a possibility that the charged mist is adhered to the recording head by being attracted to the nozzle plate side which is rather negative potential rather than heading toward the absorbing member at the positive potential, for example.

SUMMARY

An advantage of some aspects of the invention is to provide a recording apparatus capable of effectively collecting mist generated and floating when liquid is ejected from a recording head without adhering the mist to the recording head.

Hereinafter, means of the invention and operation effects thereof will be described.

There is provided a recording apparatus including an apparatus main body including a recording head that ejects liquid from a nozzle opening formed in a nozzle plate to a medium to be transported so as to pass through a position facing the nozzle plate, and an upstream electrode portion and a downstream electrode portion that are disposed on an upstream side and a downstream side in a transporting direction of the medium to sandwich the position facing the nozzle plate therebetween, in which the upstream electrode portion and the downstream electrode portion are configured such that an electric field is formed between the upstream electrode portion and the downstream electrode portion as voltages are applied.

According to the configuration, an electric field is formed between the upstream electrode portion and the downstream electrode portion as voltages are applied. That is, an electric field is formed in a lateral direction which is a direction parallel to the nozzle plate. Therefore, unlike the case where an electric field is formed in the longitudinal direction which is a direction perpendicular to the nozzle plate, it is possible to suppress the mist from being blown up toward the recording head and to attract and collect the floating mist to the side where the upstream electrode portion or the downstream electrode portion is located.

In the recording apparatus, it is preferable that the upstream electrode portion and the downstream electrode portion be disposed so as to extend in parallel with each other in a direction intersecting with a direction facing the nozzle plate and in a direction intersecting with the transporting direction of the medium.

According to the configuration, it is possible to move the mist toward the upstream electrode portion or the downstream electrode portion extending so as to intersect with the flow direction of an air current by utilizing the flow of the air current that the mist floating in the narrow space directly under the nozzle plate flows out toward the wide space expanding outside the region immediately below the nozzle plate.

In the recording apparatus, it is preferable that a supporting surface capable of supporting the medium to be transported in the transporting direction be provided at the position facing the nozzle plate and the upstream electrode portion and the downstream electrode portion be provided at a position distant from the nozzle plate than the supporting surface in a direction facing the nozzle plate.

According to the configuration, since the mist floating in the space right under the nozzle plate may be collected at a position distant from the nozzle plate than the supporting surface on which the medium is supported, it is possible to reduce the risk of contamination of the medium passing on the supporting surface.

In the recording apparatus, it is preferable that the polarities of the upstream electrode portion and the downstream electrode portion be different when voltages are applied.

According to the configuration, in either of the case where the floating mist is positively charged and the case where the floating mist is negatively charged, it is possible to attract and collect the mist to the side where the upstream electrode portion and the downstream electrode portion are located where the potential is either positive or negative.

In the recording apparatus, it is preferable that a distance between the upstream electrode portion and the downstream electrode portion in the transporting direction of the medium be shorter than a distance between the upstream electrode portion or the downstream electrode portion and the nozzle plate in a direction facing the nozzle plate.

According to the configuration, even if an electric field is formed between the upstream electrode portion or the downstream electrode portion and the nozzle plate as a voltage is applied, since the strength of the electric field between the upstream electrode portion and the downstream electrode portion is superior, it is possible to effectively suppress the mist from being blown up on the side of the nozzle plate.

In the recording apparatus, it is preferable that the recording head be made of a charging material, the apparatus main body be provided with a discharging member made of a conductive material, and the recording head may be discharged by the discharging member.

According to the configuration, the mist is easily attracted to the charged recording head, but attraction of such mist may be suppressed by attracting the electricity by the discharging member.

In the recording apparatus, it is preferable that the recording head be placed on a moving object that is movable in a direction intersecting with the transporting direction of the medium and is provided so as to come into contact with the moving object in at least one of a first end side and a second end side in a moving direction of the moving object in a state in which the discharging member is grounded.

According to the configuration, even in a case where the moving object is charged, at least one of the first end side and the second end side in the moving direction of the moving object is brought into contact with the discharging members to eliminate electricity. Therefore, it is possible to prevent the floating mist from adhering to the moving object.

In the recording apparatus, it is preferable that the recording head be placed on the moving object which is movable in a direction intersecting with a transporting direction of the medium, and the discharging member is provided in the moving object.

According to the configuration, even when the moving object is charged, it is possible to eliminate electricity with a simple configuration without requiring a wiring structure for connecting the moving object to the ground, thereby suppressing the floating mist from adhering to the moving object.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a recording apparatus of a first embodiment will be described with reference to drawings.

Figure 1:
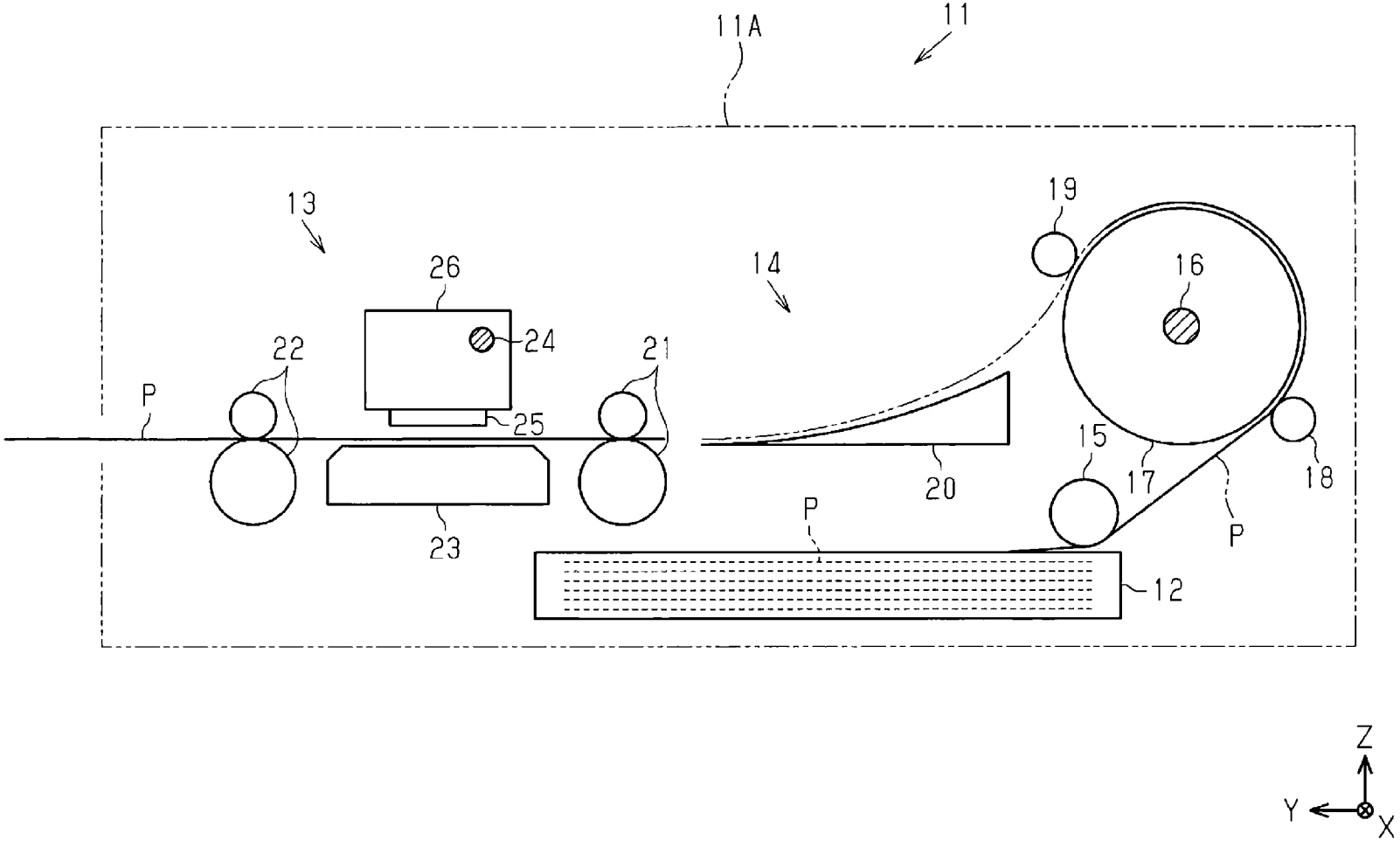
FIG. 1 is a side view schematically showing a schematic configuration of a recording apparatus according to a first embodiment.

As shown in FIG. 1, a recording apparatus 11 of the present embodiment includes an apparatus main body 11A to be a housing. Inside the apparatus main body 11A, there are provided a medium housing section 12 capable of storing a medium P in a stacked state, a recorder 13 that performs recording by ejecting liquid onto the medium P, and a medium transporter 14 that transports the medium P from the medium housing section 12 toward the recorder 13. That is, the recording apparatus 11 according to the embodiment is constituted by an ink jet type printer that performs recording by ejecting liquid such as ink onto a medium P such as paper to be transported by the medium transporter 14.

The medium transporter 14 rotates while coming into contact with the uppermost medium P among the plurality of media P stacked in the medium housing section 12, thereby includes a feeding roller 15 that feeds the media P one by one to the downstream side where the recorder 13 is located. On the downstream side of the feeding roller 15 in the feeding direction of the medium P, there is provided a reversing roller 17 which rotates around an axis 16 along an X-axis direction which is also the width direction of the fed medium P. The reversing roller 17 rotates counterclockwise in FIG. 1 in a state in which the medium P is wound around the circumferential surface thereof, thereby reversing the medium P fed by the feeding roller 15 from the medium housing section 12 to feed the medium P to the downstream side.

Around the reversing roller 17, two driven rollers 18 and 19 driven and rotated while sandwiching the medium P between the rollers and the reversing roller 17 are rotatably provided. The medium P fed to the further downstream side of the driven roller 19 located downstream of the two driven rollers 18 and 19 in the feeding direction is transported along the transporting path indicated by the two-dot chain line in FIG. 1. That is, at a position which is obliquely below the driven roller 19 on the downstream side, a guide member 20 having an inclined surface for guiding the medium P is provided so that the medium P is transported along a Y-axis direction which is the transporting direction toward the recorder 13.

Further, the medium transporter 14 includes a first transporting roller pair 21 and a second transporting roller pair 22 on the downstream side of the guide member 20 in the transporting direction. In the transporting direction (Y-axis direction) of the medium P, the first transporting roller pair 21 is provided on the upstream side of the recorder 13, and the second transporting roller pair 22 is provided on the downstream side of the recorder 13. Each of the first transporting roller pair 21 and the second transporting roller pair 22 includes a driving roller and a driven roller and are configured to transport the medium P in a horizontal state along the Y-axis direction. Then, the medium P having passed through the recorder 13 is further transported to the downstream side by the second transporting roller pair 22 on the downstream side and discharged from the inside of the apparatus main body 11A to the outside.

Figure 2:
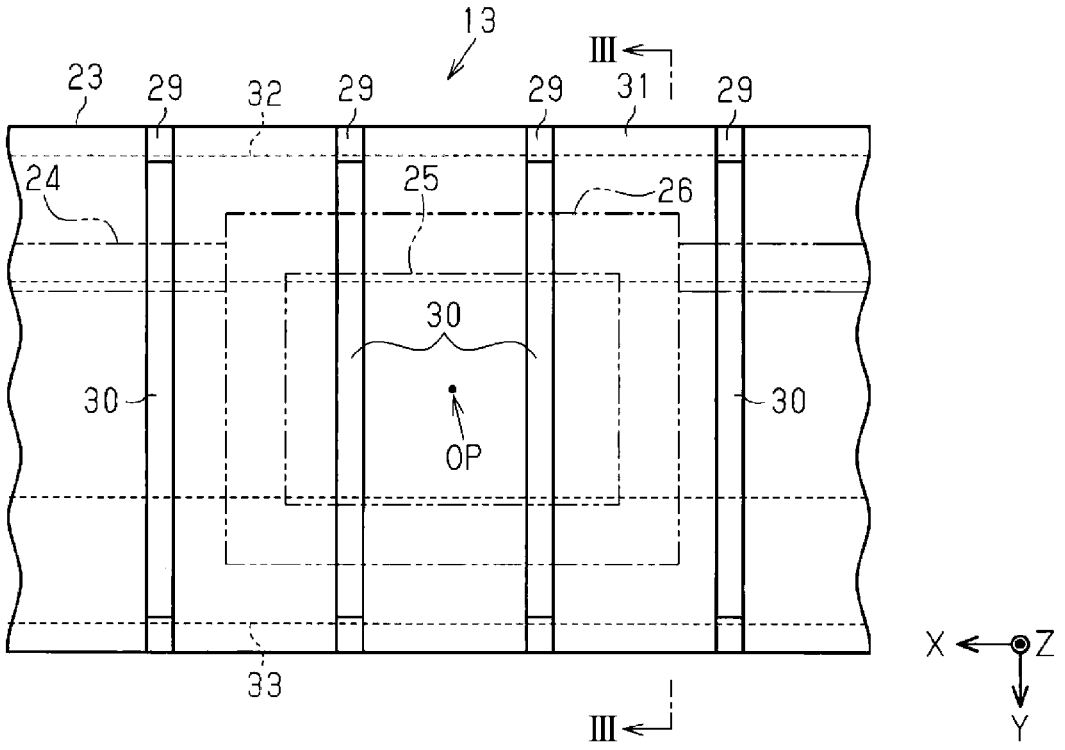
FIG. 2 is a plan view showing a part of a medium supporter.

As shown in FIGS. 1 and 2, the recorder 13 includes a medium supporter 23 that supports the medium P which is nipped by the first transporting roller pair 21 and the second transporting roller pair 22 and transported to the downstream side. The medium supporter 23 is a support base having a rectangular shape in a plan view having the X-axis direction, which is the width direction of the medium P, as a longitudinal direction, and the length thereof in the X-axis direction is longer than the width dimension of the medium P. In addition, a guide shaft 24 is provided so as to extend in the X-axis direction at a position above the medium supporter 23 in a Z-axis direction which is a vertical direction. A moving object 26 on which the recording head 25 that ejects liquid is placed is supported on the guide shaft 24 so as to reciprocate in a main scanning direction (X-axis direction)

which is the width direction of the medium P. In this respect, the recording apparatus 11 of the embodiment is a so-called serial-type printer in which recording is performed by moving a moving object on which a recording head is placed in a direction intersecting with the transporting direction of the medium.

Figure 3:
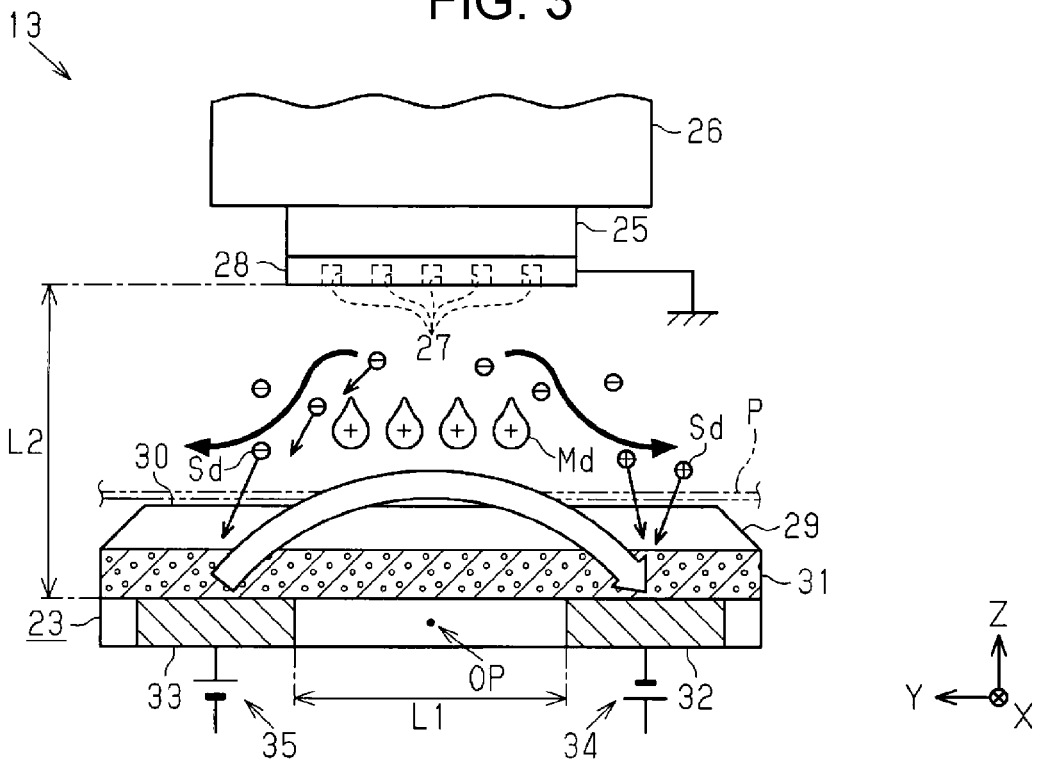
FIG. 3 is a sectional view taken along line III-III in FIG. 2.

As shown in FIGS. 2 and 3, the moving object 26 has a rectangular parallelepiped shape, and the entirety thereof is formed of a synthetic resin material such as plastic which is an example of a charging material. The recording head 25 is also mainly formed of a synthetic resin material such as plastic which is a charging material. At the lower end of the recording head 25 protruding downward from the lower surface of the moving object 26, nozzle plate 28 on which a large number of nozzle openings 27 for ejecting liquid are formed is attached so that the lower surface facing the medium supporter 23 in the vertical direction is orthogonal to the Z-axis direction which is the vertical direction. That is, the recording head 25 records on the medium P to be transported so as to pass the position facing the nozzle plate 28 to the downstream side in the transporting direction (Y-axis direction) while being supported by the medium supporter 23, by ejecting liquid from the nozzle opening 27. In addition, the nozzle plate 28 is made of a metal material such as stainless steel which is a conductive material and is grounded by a wire connected to the ground.

The medium supporter 23 has a plurality of ribs 29 in an upper region on the side facing the nozzle plate 28 of the recording head 25 in the Z-axis direction which is the vertical direction. The plurality of ribs 29 are provided so as to extend along the transporting direction (Y-axis direction) of the medium P at a plurality of positions spaced apart in the main scanning direction (X-axis direction) which is the width direction of the medium P. The upper surfaces of the ribs 29 facing the nozzle plate 28 of the recording head 25 constitute a supporting surface 30 capable of supporting the medium P to be transported in the transporting direction (Y-axis direction).

In addition, an absorbing member 31 capable of absorbing liquid is disposed in a region between the plurality of ribs 29 on the medium supporter 23. The absorbing member 31 is a mat member formed of a porous material such as a sponge, for example and is capable of absorbing the liquid ejected from the recording head 25 or mist which is fine mist-like droplets generated at the time of ejecting liquid from the recording head 25 so that the liquid or the mist comes out of the medium P. Then, as shown in FIG. 3, the upper surface of the absorbing member 31, which faces the nozzle plate 28 of the recording head 25 in the Z-axis direction which is the vertical direction, is located lower than the supporting surface 30 that supports the medium P in contact with the rear surface of the rib 29 at a position distant from the nozzle plate 28.

In addition, the medium supporter 23 has an upstream electrode portion 32 and a downstream electrode portion 33 on the lower surface side which is opposite to the upper surface side of the absorbing member 31 facing the nozzle plate 28 of the recording head 25. That is, the upstream electrode portion 32 and the downstream electrode portion 33 are provided at a position distant from the nozzle plate 28 than the absorbing member 31 in the direction (Z-axis direction) opposite to the nozzle plate 28. Therefore, the upstream electrode portion 32 and the downstream electrode portion 33 are provided at a position distant from the nozzle plate 28 more than the supporting surface 30 of the rib 29 supporting the medium P.

As shown in FIGS. 2 and 3, the upstream electrode portion 32 and the downstream electrode portion 33 are elongated plate members, the upstream electrode portion 32 is disposed on the upstream side in the transporting direction (Y-axis direction) of the medium P to sandwich a position OP facing the nozzle plate 28 of the recording head 25 in the Z-axis direction which is the vertical direction and the downstream electrode portion 33 is disposed on the downstream side. Then, the upstream electrode portion 32 and the downstream electrode portion 33 are disposed so as to extend in parallel to each other in the X-axis direction which is a direction (X-axis direction or Y-axis direction) intersecting with the direction (Z-axis direction) opposite to the nozzle plate 28 and a direction intersecting with the transporting direction (Y-axis direction) of the medium P.

The upstream electrode portion 32 and the downstream electrode portion 33 are made of a metal material such as stainless steel which is a conductive material, and a power supply 34 for applying a minus voltage is connected to the upstream electrode portion 32 while a power supply 35 for applying a plus voltage is connected to the downstream electrode portion 33. That is, the upstream electrode portion 32 and the downstream electrode portion 33 are configured so that the polarities thereof are different when voltages are applied from the power supplies 34 and 35. As a voltage is applied from each of the power supplies 34 and 35, an electric field is formed between the upstream electrode portion 32 and the downstream electrode portion 33 as indicated by outlined arrows in FIG. 3.

In addition, as shown in FIG. 3, the upstream electrode portion 32 and the downstream electrode portion 33 are disposed at respective positions separated by a distance L1 between the upstream side and the downstream side in the transporting direction (Y-axis direction) of the medium P. The distance L1 between the upstream electrode portion 32 and the downstream electrode portion 33 is shorter than a distance L2 between the upstream electrode portion 32 (or the downstream electrode portion 33) and the nozzle plate 28 in the direction (Z-axis direction) opposite to the nozzle plate 28. Therefore, when voltages are applied from the power supplies 34 and 35 to the upstream electrode portion 32 and the downstream electrode portion 33, since the nozzle plate 28 is also made of a conductive material, even if an electric field is formed between the nozzle plate 28 and the upstream electrode portion 32 (or the downstream electrode portion 33), the electric field intensity between the upstream electrode portion 32 and the downstream electrode portion 33 is superior.

Next, the operation of the recording apparatus 11 configured as described above will be described with a focus on the operation at the time of collecting the mist generated when the liquid is ejected from the recording head 25.

As liquid is ejected toward the medium P from the nozzle opening 27 of the nozzle plate 28 in the recording head 25, images such as characters and figures are recorded on the medium P. At this time, the liquid ejected as droplets from the nozzle opening 27 of the nozzle plate 28 toward the medium P on the medium supporter 23 flies to the medium supporter 23 side while being positively charged under the influence of the driving voltage (normally, positive voltage) applied for driving a piezoelectric element (not shown) in the recording head 25. Then, in the middle of flight, the droplets are separated into a relatively large particle main droplet Md that continues to fly toward the medium P while being positively charged and a relatively small particle sub-droplet Sd which is separated from the main droplet Md by air resistance and floats in a negatively charged state.

In this case, when voltages are applied to the upstream electrode portion 32 and the downstream electrode portion 33, an electric field is formed between the upstream electrode portion 32 and the downstream electrode portion 33 separated from each other by the distance L1 and between the nozzle plate 28 and the upstream electrode portion 32 (or the downstream electrode portion 33) separated from each other by the distance L2. In this case, between the nozzle plate 28 and the upstream electrode portion 32 (or the downstream electrode portion 33), an electric field is formed in the vertical direction which is a direction orthogonal to the nozzle plate 28. On the other hand, between the upstream electrode portion 32 and the downstream electrode portion 33, an electric field is formed in a lateral direction which is a direction parallel to the nozzle plate 28. In this case, since the distance L1 is shorter than the distance L2, the electric field in the lateral direction is superior in strength over the electric field in the longitudinal direction.

Therefore, the sub-droplet Sd, which is a relatively small particle mist floating in a negatively charged state, is not influenced by the electric field in the lateral direction which is superior in terms of strength and does not rise upward in the longitudinal direction on the recording head 25 side. As indicated by a thick arrow in FIG. 3, between the medium supporter 23 and the recording head 25, an air current flows from the narrow space having a relatively high flow path resistance directly under the nozzle plate 28 toward the wide outside space thereof. Then, due to the flow of the air current and the action of the electric field in the lateral direction, the relatively small particle sub-droplet (mist) Sd floating in the negatively charged state is attracted toward the downstream electrode portion 33 at the positive potential by the application of the voltage from the power supply 35. That is, the droplet moves toward the downstream electrode portion 33 extending so as to intersect with the flowing direction of the air current and adheres to and is absorbed by the absorbing member 31 located below the supporting surface 30 in the middle of the movement thereof, and therefore the droplet may be collected suitably without adhering to the recording head 25 and the moving object 26.

Among the relatively small particle sub-droplets (mist) Sd floating on the medium supporter 23, there may be the sub-droplet (mist) Sd that is positively charged instead of being negatively charged, but in that case, the droplet is attracted towards the upstream electrode portion 32 at the negative potential by the application of the voltage from the power supply 34 and is similarly absorbed by the absorbing member 31 and collected.

According to the first embodiment, the following effects may be obtained.

(1-1) An electric field is formed between the upstream electrode portion 32 and the downstream electrode portion 33 located separated by the distance L1 in the transporting direction (Y-axis direction) as voltages are applied from the power supplies 34 and 35. That is, an electric field is formed in a lateral direction which is a direction parallel to the nozzle plate 28. Therefore, unlike the case where an electric field is formed in the longitudinal direction which is a direction perpendicular to the nozzle plate 28, it is possible to suppress the mist (sub-droplet Sd) from being blown up toward the recording head 25 and to attract and collect the floating mist to the side where the upstream electrode portion 32 or the downstream electrode portion 33 is located.

(1-2) It is possible to move the mist (sub-droplet Sd) toward the upstream electrode portion 32 or the downstream electrode portion 33 extending so as to intersect with the flow direction of the air current by utilizing the flow of the air current that the mist floating in the narrow space directly under the nozzle plate 28 flows out toward the wide space expanding outside the region immediately below the nozzle plate 28.

(1-3) Since the mist (sub-droplet Sd) floating in the space right under the nozzle plate 28 may be collected at a position distant from the nozzle plate 28 than the supporting surface 30 on which the medium P is supported, it is possible to reduce the risk of contamination of the medium P passing on the supporting surface 30.

(1-4) In either of the case where the floating mist (sub-droplet Sd) is positively charged and the case where the floating mist is negatively charged, it is possible to attract and collect the mist to the side where the upstream electrode portion 32 and the downstream electrode portion 33 are located where the potential is either positive or negative.

(1-5) Even if an electric field is formed between the upstream electrode portion 32 (or the downstream electrode portion 33) and the nozzle plate 28 as a voltage is applied, since the strength of the electric field between the upstream electrode portion 32 and the downstream electrode portion 33 is superior, it is possible to effectively suppress the mist (sub-droplet Sd) from being blown up on the side of the nozzle plate 28.

Second Embodiment

Next, the recording apparatus 11 of a second embodiment will be described with reference to drawings. In the second embodiment, in contrast with the first embodiment, the configuration is different from the first embodiment in that a discharging member is provided in the recorder 13, and other configurations are common. Therefore, in the following, differences from the first embodiment will mainly be described.

Figure 4:
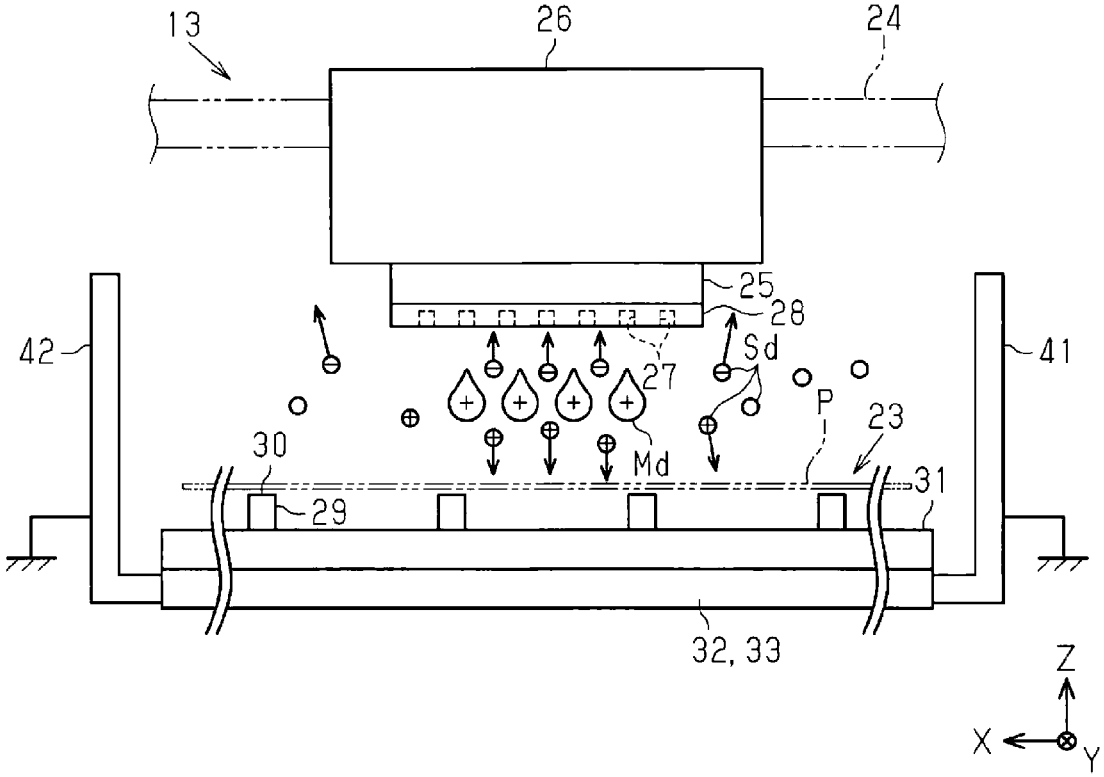
FIG. 4 is a front view schematically showing a schematic configuration of a main portion in a recording apparatus according to a second embodiment.

As shown in FIG. 4, in the recorder 13 of the recording apparatus 11 of the embodiment, discharging members 41 and 42 made of a conductive material are provided on a first end side (right end side in FIG. 4) and a second end side (left end side in FIG. 4) in the X-axis direction which is the main scanning direction in which the moving object 26 moves. The discharging member 41 on the first end side is formed so that at least the front-end side of the discharging member 41 is more flexible than a rubber material in which metal powder is blended into the raw material, for example. Then, when the moving object 26 moves to the first end side, the moving object 26 is configured to function as a wiper that wipes the nozzle plate 28 by bending and deforming while contacting with the nozzle plate 28 of the recording head 25.

On the other hand, the discharging member 42 on the second end side is a frame made of a metal material such as stainless steel, and when the moving object 26 moves to the second end side, the discharging member 42 is configured to contact the nozzle plate 28 of the recording head 25. The discharging member 41 at the first end functioning as a wiper and the discharging member 42 at the second end as a frame are grounded by wires connected to the ground, respectively.

In the embodiment as well, in the middle of flight, the liquid ejected as droplets from the nozzle opening 27 of the nozzle plate 28 in the recording head 25 are separated into the relatively large particle main droplet Md that continues to fly toward the medium P while being positively charged and the relatively small particle sub-droplet Sd which is separated from the main droplet Md by air resistance and floats in a negatively charged state. In addition, immediately after separation, the sub-droplets (mist) Sd separated from the main droplet Md by air resistance float in an uncharged state, and thereafter, some of the sub-droplets Sd float while being negatively or positively charged due to induction phenomenon from the upstream electrode portion 32 or the downstream electrode portion 33 to which a voltage is applied.

In this case, with respect to the sub-droplet (mist) Sd floating by being negatively or positively charged, due to the induction phenomenon from the upstream electrode portion 32 or the downstream electrode portion 33 to which the voltage is similarly applied, in a case where the recording head 25 and the moving object 26 made of the charging material are charged, there is a possibility that the recording head 25 and the moving object 26 are attracted to the recording head 25 and the like and adhere thereto. The adhesion of the sub-droplet Sd is not eliminated unless the electric potential is dropped from the charged recording head 25 or the moving object 26. Therefore, in the embodiment, adhesion of the sub-droplet Sd to the recording head 25 and the moving object 26 is suppressed as follows.

Figure 5:
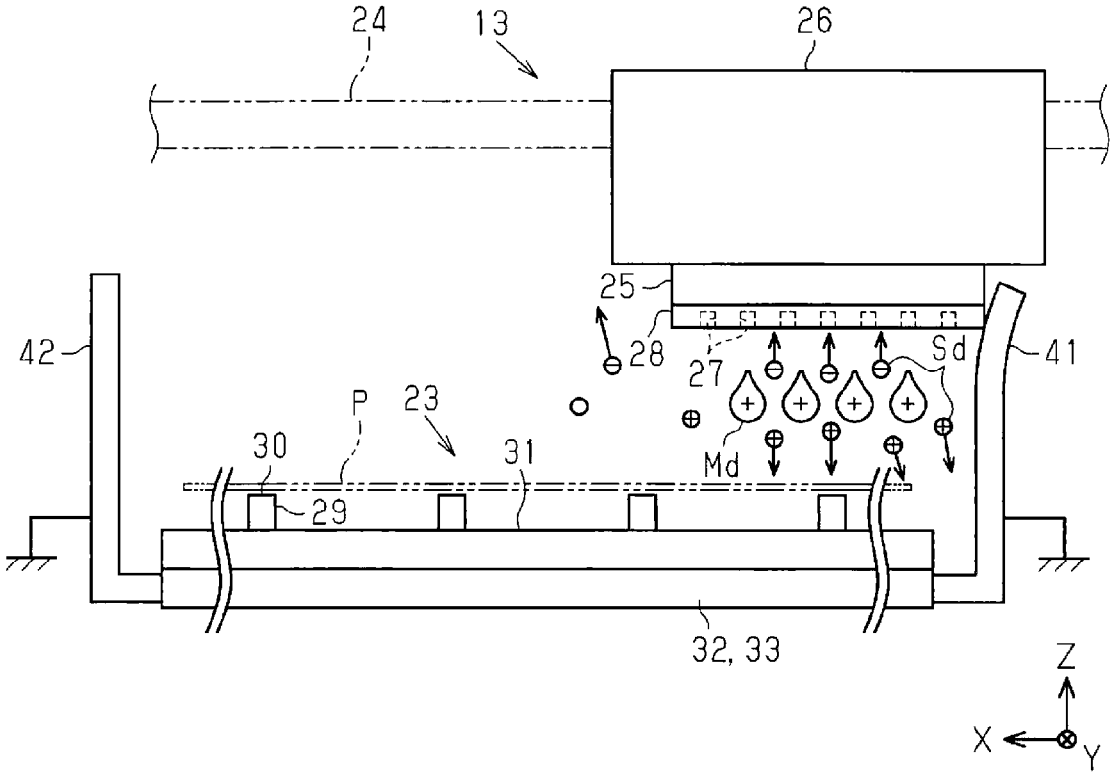
FIG. 5 is a front view showing a state in which a recording head has moved due to discharging from the state of FIG. 4.

That is, as shown in FIG. 5, the moving object 26 is moved to the first end side in the main scanning direction (X-axis direction). Then, the discharging member 41 provided on the first end side contacts the nozzle plate 28 of the recording head 25. In this case, both the nozzle plate 28 and the discharging member 41 are made of a conductive material, and the discharging member 41 is grounded by a wire connected to the ground. Therefore, even if the recording head 25 and the moving object 26 are charged, electricity is eliminated via a current-flowing path constituted by the nozzle plate 28, the discharging member 41, and the ground wire. As a result, it is possible to reduce the possibility that the sub-droplet (mist) Sd floating by being negatively or positively charged is attracted to the side of the recording head 25 and the like and adhere thereto.

According to the second embodiment, in addition to the effects (1-1) to (1-5) in the first embodiment, the following effects may be obtained.

(2-1) The floating sub-droplet (mist) Sd is likely to be attracted to the charged recording head 25, with respect to the recording head 25 charged in this manner, electricity is eliminated by the discharging members 41 and 42, and therefore it is possible to suppress the attraction of such the sub-droplet (mist) Sd.

(2-2) Even in a case where the moving object 26 is charged, at least one of the first end side and the second end side in the moving direction of the moving object 26 is brought into contact with the discharging members 41 and 42 to eliminate electricity. Therefore, it is possible to prevent the floating sub-droplet (mist) Sd from adhering to the moving object 26.

Third Embodiment

Next, the recording apparatus 11 of a third embodiment will be described with reference to drawings. In the third embodiment, in contrast with the first embodiment, the configuration is different from the first embodiment in that a discharging member is provided in the moving object 26, and other configurations are common. Therefore, in the following, differences from the first embodiment will mainly be described.

Figure 6:
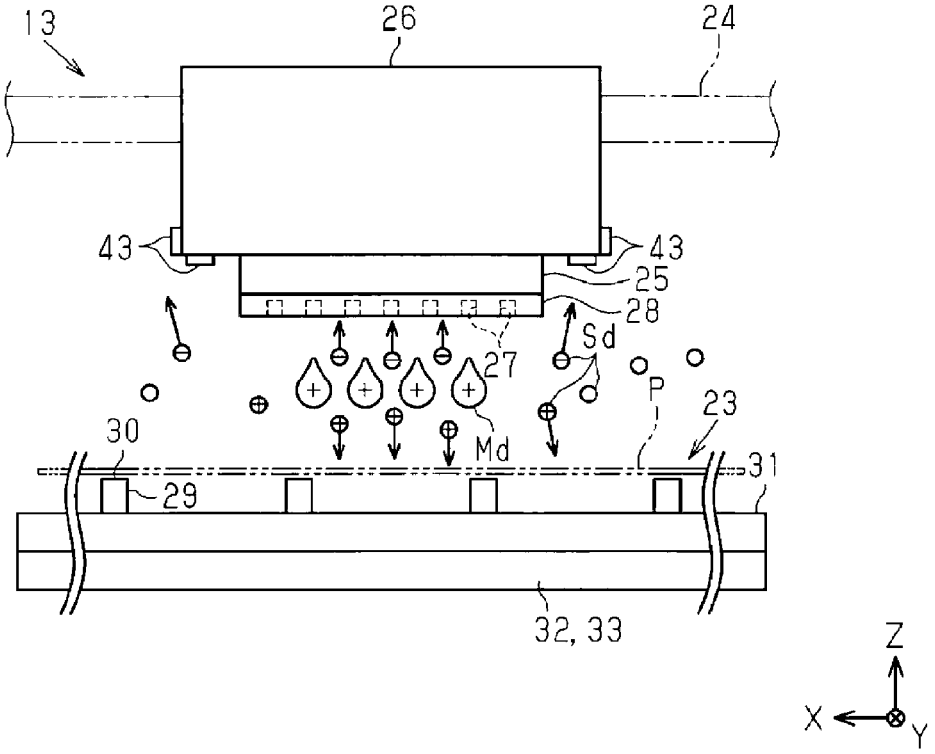
FIG. 6 is a front view schematically showing a schematic configuration of the main portion in a recording apparatus according to a third embodiment.

As shown in FIG. 6, in the recorder 13 of the recording apparatus 11 of the embodiment, the moving object 26 on which the recording head 25 is placed moving in the main scanning direction (X-axis direction) is provided with a discharging member 43 made of a conductive material. Unlike the discharging member 41 functioning as a wiper in the second embodiment and the discharging member 42 as a frame, the discharging member 43 is not provided so as to contact the moving object 26 on the moving path of the moving object 26, but is provided on the moving object 26 itself.

That is, the discharging member 43 in the embodiment is a discharging cloth including conductive fibers and is attached to at least one position (four positions in FIG. 6) of the side surface and the lower surface of the moving object 26 made of a charging material. Even if the discharging member 43 of the discharging cloth does not come into contact with another specially grounded discharging member when the moving object 26 moves in the main scanning direction (X-axis direction), the moving object 26 is discharged by being discharged from the discharging member 43 which is a discharging cloth into the air.

According to the third embodiment, in addition to the effects (1-1) to (1-5) in the first embodiment, the following effects may be obtained.

(3-1) Even in a case where the moving object 26 is charged, it is possible to eliminate electricity with a simple configuration without requiring a wiring structure for connecting the moving object 26 to the ground, thereby suppressing the floating sub-droplet (mist) Sd from adhering to the moving object 26.

Each of the above embodiments may be modified as shown in the following modification example. In addition, the configurations included in these embodiments and the configurations included in the following modification examples may be combined arbitrarily or the configurations included in the following modification examples may be arbitrarily combined.

- In the third embodiment, the discharging member 43 made of a discharging cloth may be made of a discharging brush formed of conductive fluff or the like, or a discharging needle formed in a pointed shape with a conductive material. In short, the configuration suffices as long as the mist is attached to the moving object 26 so that the mist may be discharged into the air.
- In addition, the number and position of the discharging members 43 provided on the outer surface of the moving object 26 are not limited to the case of the third embodiment and may be arbitrary.
- In the second embodiment, the configuration may be such that the discharging member 41 on the first end side in the direction in which the moving object 26 moves functions as a frame and the discharging member 42 on the second end side functions as a wiper.
- In the second embodiment, the configuration may be such that both discharging members 41 and 42 on the first end side and the second end side function as frames or function as wipers.
- In the second embodiment, one of the discharging members 41 and 42 on the first end side and the second end side may be omitted.
- In each of the above embodiments, the distance L1 between the upstream electrode portion 32 and the downstream electrode portion 33 may be equal to the distance L2 between the upstream electrode portion 32 (or the downstream electrode portion 33) and the nozzle plate 28.
- In each of the above-described embodiments, the configuration may be such that either one of the upstream electrode portion 32 and the downstream electrode portion 33 is grounded by a wire connected to the ground and voltages are not applied from the power supplies 34 and 35.

In each of the above embodiments, the configuration may be such that the absorbing member 31 is not provided in the medium supporter 23. In this case, the floating sub-droplet (mist) Sd is recovered by being adhered to a region between the adjacent ribs 29 on the medium supporter 23 which is a support base.

In each of the above embodiments, the upstream electrode portion 32 and the downstream electrode portion 33 may not be configured to have a long plate-like member extending in the main scanning direction (X-axis direction), but may have a configuration in which a plurality of conductive members are arranged in the main scanning direction (X-axis direction), for example. In short, any configuration suffices as long as a plurality of conductive members are disposed on the upstream side and the downstream side in the transporting direction (Y-axis direction) of the medium P to sandwich the position OP facing the nozzle plate 28 therebetween.

The recording apparatus 11 may be a so-called line head printer that performs printing by the recording head 25 having a group of nozzles covering the entire width direction intersecting with the transporting direction of the medium P being fixedly disposed and liquid being ejected from the recording head 25 to the medium P to be transported at a position facing the recording head 25.

The entire disclosure of Japanese Patent Application No. 2017-189829, filed Sep. 29, 2017 is expressly incorporated by reference herein.

What is claimed is:

1. A recording apparatus comprising:

an apparatus main body including a recording head that ejects liquid from a nozzle opening formed in a nozzle plate; and an upstream electrode portion and a downstream electrode portion that are disposed on an upstream side and a downstream side in a transporting direction of a medium to sandwich a position facing the nozzle plate therebetween, wherein the upstream electrode portion and the downstream electrode portion are configured such that an electric field is formed between the upstream electrode portion and the downstream electrode portion as voltages of opposite polarities are applied to the upstream electrode portion and the downstream electrode portion.

2. The recording apparatus according to claim 1, wherein the upstream electrode portion and the downstream electrode portion are disposed so as to extend in parallel with each other in a direction intersecting with a direction facing the nozzle plate and in a direction intersecting with the transporting direction of the medium.

3. The recording apparatus according to claim 1, wherein a supporting surface that is configured to support the medium to be transported in the transporting direction is provided at the position facing the nozzle plate, and the upstream electrode portion and the downstream electrode portion are provided at a position distant from the nozzle plate than the supporting surface in a direction facing the nozzle plate.

4. The recording apparatus according to claim 1, wherein polarities of the upstream electrode portion and the downstream electrode portion are configured to be different when voltages are applied.

5. The recording apparatus according to claim 1, wherein a distance between the upstream electrode portion and the downstream electrode portion in the transporting direction of the medium is shorter than a distance between the upstream electrode portion or the downstream electrode portion and the nozzle plate in a direction facing the nozzle plate.

6. The recording apparatus according to claim 1, wherein the recording head is made of a charging material, the apparatus main body is provided with a discharging member made of a conductive material, and the recording head is dischargeable by the discharging member.

7. The recording apparatus according to claim 6, wherein the recording head is placed on a moving object that is movable in an axis intersecting with the transporting direction of the medium and is provided so as to come into contact with the moving object in at least one of a first end side and a second end side in a moving axis of the moving object in a state in which the discharging member is grounded.

8. The recording apparatus according to claim 6, wherein the recording head is placed on a moving object which is movable in an axis intersecting with a transporting direction of the medium, and the discharging member is provided in the moving object.

* * * * *